US006248215B1

(12) United States Patent
Cramer et al.

(10) Patent No.: US 6,248,215 B1
(45) Date of Patent: Jun. 19, 2001

(54) CALENDER AND METHOD FOR TREATING MATERIAL WEBS IN THE CALENDER

(75) Inventors: Dirk Cramer, Duisburg; Ulrich Wagner, Wachtendonk, both of (DE)

(73) Assignee: Voith Sulzer Finishing GmbH, Krefeld (DE)

( * ) Notice: Subject to any disclaimer, the term of this patent is extended or adjusted under 35 U.S.C. 154(b) by 0 days.

(21) Appl. No.: 09/107,148

(22) Filed: Jun. 30, 1998

(30) Foreign Application Priority Data

Jul. 10, 1997 (DE) ..... 197 29 531

(51) Int. Cl.[7] ..... D21F 3/00

(52) U.S. Cl. ..... 162/358.3; 162/198; 162/DIG. 10; 162/205; 162/358.2; 162/360.3; 162/262; 100/162 R; 100/163 R; 100/163 A; 100/47; 100/35; 100/168; 100/120

(58) Field of Search ..... 100/162 R, 163 R, 100/163 A, 47, 35, 168, 170; 162/198, DIG. 10, 205, 358.13, 358.2, 360.3, 262

(56) References Cited

U.S. PATENT DOCUMENTS

| | | | |
|---|---|---|---|
| 3,584,570 | 6/1971 | Krefeld et al. . | |
| 4,326,456 | 4/1982 | Kankaanpaa . | |
| 4,366,752 | 1/1983 | Koski . | |
| 4,375,188 | 3/1983 | Leiviskä . | |
| 4,597,275 | 7/1986 | Schneid et al. . | |
| 4,625,637 | 12/1986 | Pav et al. . | |
| 4,924,772 | 5/1990 | Schlunke et al. . | |
| 5,038,678 | 8/1991 | Honkala et al. . | |
| 5,131,324 | 7/1992 | Lassila et al. . | |
| 5,673,617 | 10/1997 | Linder . | |
| 5,947,017 * | 9/1999 | Hartwich et al. | 100/163 A |

FOREIGN PATENT DOCUMENTS

| | | |
|---|---|---|
| 3012852 | 10/1981 | (DE) . |
| 3119677 | 1/1982 | (DE) . |
| 19520109 | 6/1996 | (DE) . |
| 19631056 | 2/1998 | (DE) . |
| 0661405 | 7/1995 | (EP) . |
| 0732445 | 9/1996 | (EP) . |
| 0822289 | 2/1998 | (EP) . |
| 2237295 | 5/1991 | (GB) . |
| 58-91890 | 5/1983 | (JP) . |
| 63-196792 | 8/1988 | (JP) . |
| 2102914 | 4/1990 | (JP) . |
| 1124070 | 11/1984 | (SU) . |

* cited by examiner

*Primary Examiner*—Stanley S. Silverman
*Assistant Examiner*—Mark Halpern
(74) *Attorney, Agent, or Firm*—Greenblum & Bernstein, P.L.C.

(57) ABSTRACT

Calender and method for treating a material web. The calender includes a plurality of rolls in which each roll has a rotational axis. The rotational axes of the plurality of rolls are arranged to be substantially located in a press plane, and a plurality of nips are formed between adjacent rolls. A control device is provided to selectively open and close the plurality of nips, and the rolls are arranged so that at least two opened nips are positioned between two closed nips. The method includes forming a closed nip with the top roll, forming a closed nip with the bottom roll, forming at least two open nips between closed nips, and guiding the material web through at least the closed nips.

35 Claims, 2 Drawing Sheets

CALENDER AND METHOD FOR TREATING MATERIAL WEBS IN THE CALENDER

CROSS-REFERENCE TO RELATED APPLICATIONS

The present application claims priority under 35 U.S.C. §119 of German Patent Application No. 197 29 531.2, filed on Jul. 10, 1997, the disclosure of which is expressly incorporated by reference herein in its entirety.

BACKGROUND OF THE INVENTION

1. Field of the Invention

The present invention relates to a calender with a plurality of rolls having axes located in a press plane. The plurality of rolls are arranged such that adjacent rolls form a nip between each other, and the calender includes a control device to open and close the nips.

2. Discussion of Background Information

During the glazing of a paper web, the paper web is guided through a calender and, within the nips (or roll openings) of the calender, is pressed under pressure, and, if necessary, with an increased temperature. This method of pressure treatment in the calender determines the surface characteristics of the processed web. Thus, it is apparent that the quality of the web surface can be improved by increasing the number of the nips.

However, in many cases a high surface quality is not necessary or desired. In other words, a lower number of nips may be utilized to produce a web with adequate surface characteristics.

For example, it is known from EP 0 661 405 A1 to provide a calender with four rolls and three nips, and that the rolls are adjustable so that the calender includes three, two, or even only one nip. When less than three nips are utilized, the bottom nip or nips are closed, while the other, i.e., upper, nips remain open. The line load that effects the paper web can be altered in this arrangement, e.g., utilizing three deflection adjustment rolls. Moreover, the sequence of the nips is fixed, i.e., when both nips are closed, treatment in the third nip must follow treatment in the second nip. In this manner, possibilities of variation are somewhat limited.

Another calender is discussed in German Patent Application No. 196 31 056, in which a roll stack having several nips in a calender is combined with a roll pair having only one nip. Both roll stacks have a common roll and can be driven alternatively. However, in this case, the industrial expenditure is relatively high due to an additional deflection adjustment roll with two operational directions.

SUMMARY OF THE INVENTION

The present invention increases operational flexibility of a calender during the glazing of material webs while maintaining a reasonable cost of operation.

The calender of the present invention, which is similar in general to the calender discussed above, provides positionally adjustable rolls so that at least two opened nips are positioned between two closed nips.

In accordance with this embodiment, the calender may alternatively be operated so that all nips may be closed, i.e., pressure is imparted on the material web in all nips. In this manner, surface quality of the web will be relatively high. Likewise, the calender may be operated so that all nips are not closed. Thus, in contrast to known calenders, the user chooses, e.g., at the beginning of the material web treatment, which nips are unnecessary and should simply be left out, i.e., remain open. Thus, the material web is glazed in one or more closed nips, bypasses the unnecessary nips that remain open, and is further treated in a subsequent closed nip or nips. Since the nips that do not treat the material web remain open, the rolls are conserved here. With soft nips, in particular, in which the nip is formed with a roll having a soft surface layer, it is practically impossible to close the nip without web being guided therethrough, without adversely effecting, and generally, destroying the soft roll surface. That is, the web is utilized as an insulator, and when lacking, inconsistent temperature rises on the elastic coating over time may lead to the undesired destruction of the soft roll surface, e.g., the covering thermally embosses itself and is destroyed. Moreover, contaminations leaking into the roll opening can lead to surface damage on the covering. However, if the nips remain open, this danger does not exist. Thus, it is no longer necessary to be committed to executing a treatment cycle of nips, as determined by the roll cycle in the calender. Because the nips remain open and the web can be redirected, the pattern of the treatments steps of the material web can be selected relatively freely. Thus, in the present invention, the calender combines the ability to perform glazing to attain a high gloss or high smoothness and the ability,to produce a reduced surface quality via a treatment in a lower number of nips. Thus the operational possibilities of the calender are expanded.

In a particular embodiment, the closed nips are formed by the two outer roll pairs to simplify control of the rolls. In many currently available calenders in the art, the rolls are driven apart so that all nips are opened, e.g., to introduce or thread the paper web. However, according to the present invention, when only the two outer roll pairs are utilized to form the closed nips, then it is necessary only to move two rolls to close the nips.

In a particular embodiment, the two end rolls are formed as deflection adjustment rolls. In this manner, the two closed nips may have pressure forces applied that exceed the forces necessary to balance the individual weight of the rolls. Thus, treatment possibilities are expanded.

From the rolls bordering the two closed nips, it may be advantageous if at least one of the rolls is driven. In this way, treatment of the material web is possible in both nips without the material web being exposed to prohibitively high tensile forces. All rolls may advantageously have their own drive and at least the drives of the rolls that border the opened nips may be individually controlled. These drives may be shut off if the nips remain open so that the rolls of an open nip to do not rotate.

It may be advantageous to positionally fix one of the rolls forming the closed nip in a stay. This arrangement will simplify the control for producing the closed nip because the other roll must only be advanced, i.e., guided toward the positionally fixed roll, and, if necessary, pressed by the positionally fixed roll.

It may be particularly advantageous to arrange the top roll as the fixed roll and provide the bottom roll with a lifting drive. Similar construction is known from conventional calenders, in which all nips are closed by the lowest roll being lifted, thereby lifting all the rolls until the second roll from the top forms a closed nip with the top roll. Thus, with two simple modifications in accordance with the present invention, the known calender arrangement may be reconstructed into a more flexible calender. For this, only the second roll from the bottom may be able to be stopped, or be provided with a stop, and the second roll from the top must be provided with its own lifting drive. As noted above, conversion is simple and can also be undertaken with existing calenders.

It is advantageous that at least one roll can be positionally stopped upon closing the at least one nip and that the other roll includes a pressure transducer. In order to close the nips, therefore, only a single roll movement is necessary. The other roll becomes positionally fixed.

In this manner, it is especially advantageous that the pressure transducer works upon one end of a two-armed lever and the other roll is arranged on the other end of the lever. Enough space at the location of the pressure transducer is thus present, and the leverage can be utilized to guarantee a suitable power impingement in the nip.

The other roll is preferably designed as a roll with a press jacket. This is a possibility which can be selected as an alternative or in addition to the use of a pressure transducer on a two-aimed lever. With a roll with a press jacket, the necessary pressure may be created in the nip so that the entire roll jacket is displaced.

It is advantageous that both closed nips are formed as soft nips. In this manner, the calender may be made either as a conventional multi-roll calender with a plurality of nips or as a succession of soft calenders, each with only one soft roll opening.

It is advantageous that one of the opened nips is provided as an alternate opening. A roll opening of this kind is necessary in a calender, in which all rolls are disposed in a stay, but in which both sides of the material web are to be imparted upon uniformly. Further, idling should be avoided in the alternate opening in which two soft rolls are positioned adjacent each other.

Accordingly, the present invention is directed to a calender that includes a plurality of rolls having axes arranged to be substantially located in a press plane, and a plurality of nips are formed between adjacent rolls. A control device is provided to selectively open and close the plurality of nips, and the rolls are arranged so that at least two opened nips are positioned between two closed nips.

In accordance with another feature of the present invention, the closed nips are formed by both outer roll pairs. Further, both end rolls include deflection adjustment rolls.

In accordance with another feature of the present invention, at least one of the plurality of rolls forming the two closed nips includes a driven roll. Further, all of the plurality of rolls include driven rolls, and the driven rolls that border only the open nips are controlled individually.

In accordance with another feature of the present invention, one of the plurality of rolls forming a closed nip are positionally fixed in a stay. Further, the positionally fixed roll is the top roll and the bottom roll includes a lift drive.

In accordance with another feature of the present invention, one of the rolls forming one of the two closed nips is stopped by at least one stopping device and one of the rolls forming the other of the two closed nips includes a pressure transducer. Further, the calender includes a two-armed lever having two ends and the pressure transducer is positioned to operate on one end of the two-armed lever and the roll forming the other of the two closed nips is positioned on the other end of the two-armed lever.

In accordance with another feature of the present invention, at least one of the plurality of rolls is positionally fixed and includes a press jacket roll.

In accordance with another feature of the present invention, the two closed nips include soft nips.

In accordance with another feature of the present invention, one of the open nips includes an alternate opening. Further, the alternate opening is formed between two soft rolls.

In accordance with another feature of the present invention, the plurality of rolls includes six rolls.

In accordance with another feature of the present invention, the calender further including deflection rolls arranged to bypass the open nips.

The present invention is also directed to a calender that includes a plurality of rolls substantially parallelly arranged in a press plane. The plurality of rolls includes a top roll and a bottom roll. A control device is provided that moves the plurality of rolls substantially along the press plane to selectively open and close press nips, and the control device is adapted to move the plurality of rolls to form at least two open nips between closed nips.

In accordance with another feature of the present invention, the plurality of rolls further includes a top counter roll associated with the top roll to form a first press nip, and a bottom counter roll associated with the bottom roll to form a second press nip. Further, the top counter roll and the bottom counter roll include a roll having a hard outer surface, and the plurality of rolls further include a first soft roll and a second soft roll positioned between the top and bottom counter rolls. Further still, the first and second soft rolls form an alternate nip. Still further, each of the plurality of rolls are driven rolls and the first and second soft rolls are driven independently of the remainder of the plurality of rolls.

In accordance with another feature of the present invention, the control device is adapted to relatively move the top roll and top counter roll into contact to close the first press nip. Further, the calender includes a two-armed lever coupled to the top counter roll, a pressure transducer coupled to the two-armed lever to selectively open and close the first press nip, and the top roll being substantially positionally fixedly in the press plane Alternatively, the calender includes a lever coupled to the top counter roll to positionally fix the top counter roll in the press plane, and the top roll includes a press jacket roll adapted to press the press jacket against the top counter roll.

In accordance with another feature of the present invention, the control device is adapted to relatively move the bottom roll and the bottom counter roll into contact to close the second press nip. Further, the calender includes a slider device coupled to the bottom roll, a driver device adapted to move the slider device substantially parallel to the press plane to selectively open and close the second press nip, a lever coupled to the bottom counter roll, and a stop element coupled to the lever to positionally fix the bottom counter roll in the press plane.

In accordance with another feature of the present invention, the calender includes a plurality of deflection rolls arranged to guide a material web through the closed nips and to bypass the open nips.

The present invention is also directed to a method for treating a material web in a calender having a plurality of rolls substantially parallelly arranged in a press plane that includes a top roll and a bottom roll, and a control device that moves the plurality of rolls substantially along the press plane to selectively open and close press nips. The method includes forming a closed nip with the top roll, forming a closed nip with the bottom roll, forming at least two open nips between the closed nips, and guiding the material web through the closed nips.

In accordance with another feature of the present invention, the forming of the closed nip with the top roll includes fixing a position of the top roll to substantially prevent radial movement, and applying pressure to one arm of a two-armed lever to press a top counter roll against the top roll. Alternatively, the forming of the closed nip with the top roll includes fixing a position of the top roll to substantially prevent radial movement, wherein the top roll is comprised of a press jacket roll, fixing a position of a top counter roll adjacent the top roll, and pressing the press jacket of the press jacket roll against the top counter roll.

In accordance with another feature of the present invention, the forming of the closed nip with the bottom roll includes fixing a position of a bottom counter roll to substantially prevent radial movement, and radially moving the bottom roll to press the bottom roll against the bottom counter roll.

In accordance with another feature of the present invention, the method includes positioning two soft rolls between, but not adjacent to, the top roll and the bottom roll. Further, the method includes driving the two soft rolls independently of the top roll and the bottom roll.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of preferred embodiments of the present invention, in which like reference numerals represent similar parts throughout the several views of the drawings, and wherein.

DETAILED DESCRIPTION OF THE PRESENT INVENTION

Figure 1:
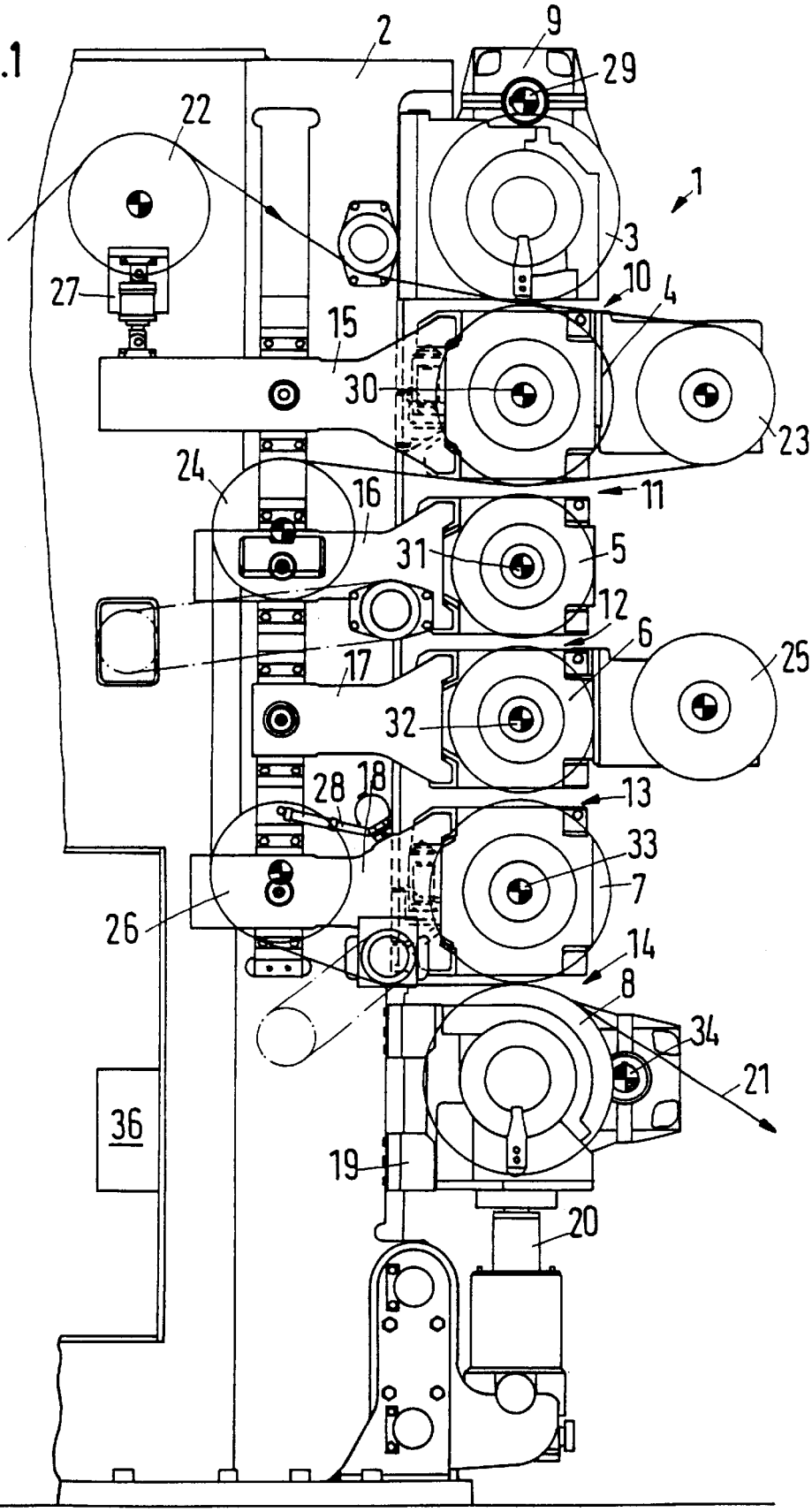
FIG. 1 illustrates a first embodiment of a calender in accordance with the present invention.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

The present invention as described herein discusses calenders utilized to treat material webs, e.g., to glaze paper webs. However, it is noted that the present invention is not limited to paper webs, and that the features of the present invention may be utilized by the ordinarily skilled artisan with many other material webs and similar products.

A calender 1 includes six rolls 3–8 mounted in a rolling stand 2. The axes of rolls 3–8 are positioned within a press plane 9.

Respectively adjacent rolls may be utilized to form nips or roll openings 10–14. If rolls 3–8 are driven apart, then nips 10–14 are opened. If rolls 3–8 are driven together, then nips 10–14 are closed. For this, top roll 3 is substantially positionally fixed in rolling stand 2 to resist radial movement, middle rolls 4–7 are coupled to levers 15–18, which are mounted on rolling stand 2 for radial movement substantially within press plane 9, and bottom roll 8 is coupled to a slide 19 in rolling stand 2 that is driven by a lifting cylinder 20 to radially displace bottom roll 8. If lifting cylinder 20 is lowered, then levers 15–18 can be swivelled downwardly to rest upon stops (not depicted) mounted to rolling stand 2.

The method of operating such a calender is known in the prior art. That is, in the closed nips, the material web may be treated with pressure and, if necessary, with an increased temperature. Further, bottom roll 8 and, if necessary, top roll 3 may be formed as deflection adjustment rolls. Rolls 3, 5, 6, and 8 may include an elastic surface covering so that nips 10, 11, 13, and 14 are formed as "soft roll openings." Middle nip 12 may be formed as an "exchange opening," i.e., two soft rolls are positioned adjacent each other. In contrast, rolls 4 and 7 may be provided with hard surfaces.

Moreover, a plurality of deflection rolls 22–26 may be provided to guide a material web 21 through calender 1.

Material web 21, e.g., a paper web, may be treated in all nips 10–14 in a operational manner that is known in the prior art. Further, material web 21 may be alternatively treated, as depicted in FIG. 1, so that only nips 10 and 14 are closed, and, thus, utilized in treating the web.

In this regard, rolls 3–8 of calender 1 are adjustable so that only rolls 3 and 4 and rolls 7 and 8 are pushed against each other to form closed nips 10 and 14. Thus, nips 11–13 are maintained as open nips. In this manner, material web 21 is treated in two soft nips 10 and 14 so that each side of material web 21 lies at one time on a surface of a soft roll. Deflection rolls 24 and 26 serve to conduct or guide material web 21 past open nips 12 and 13, i.e., to bypass the open nips which are not necessary in this treatment of material web 21. Material web 21 passes through open nip 11 without any treatment to the material web occurring.

Control of the rolls necessary for closing nips 10 and 14 is provided in the following manner. As with the existing arrangements, top roll 3 is substantially positionally fixed in rolling stand 2 against radial movement. Roll 4, which is the roll second from the top, is mounted on an arm of a two-armed lever 15. A pressure transducer 27 may be positioned to engage the other arm of lever 15. If pressure transducer 27, which may be, e.g., a piston-cylinder-unit, moves the arm of lever 15 downwardly, then roll 4 will be pushed upwardly against top roll 3. Since top roll 3 is formed as a deflection adjustment roll, relatively wide areas of pressure forces to be produced by pressure transducer 27 may be freely selected by the user.

Lever 18, to which roll 7 is mounted, is positionally stopped, in the lowered position, against radial movement via a locking device 28 coupled to rolling stand 2. Remaining nips 11–13 remain opened. Nip 14 may be closed by cylinder 20 pressing slide 19 upward to lift bottom roll 8. Because bottom roll 8 is also formed as a deflection adjustment roll, the forces for initially closing nip 14 may be freely selected by the user.

Rolls 3–8 may be provided with their own drives 29–34. However, at least the drives of rolls 5 and 6, which border and form only open nips 11–13, are to be controlled independently from the remaining drives. In this manner, rotational driving of rolls 5 and 6 may be stopped when nips 11–13 are opened, and, thus, not included in the treatment of material web 21.

In the exemplary embodiment, a complete glazing can be executed in five nips, i.e., nips 10–14, of calender 1 to obtain a high surface quality, i.e., high glossy and smoothness values, and, alternatively, material web 21 can be treated in only two nips to produce a web that, while having decreased surface quality, is sufficient for many purposes in application.

Figure 2:
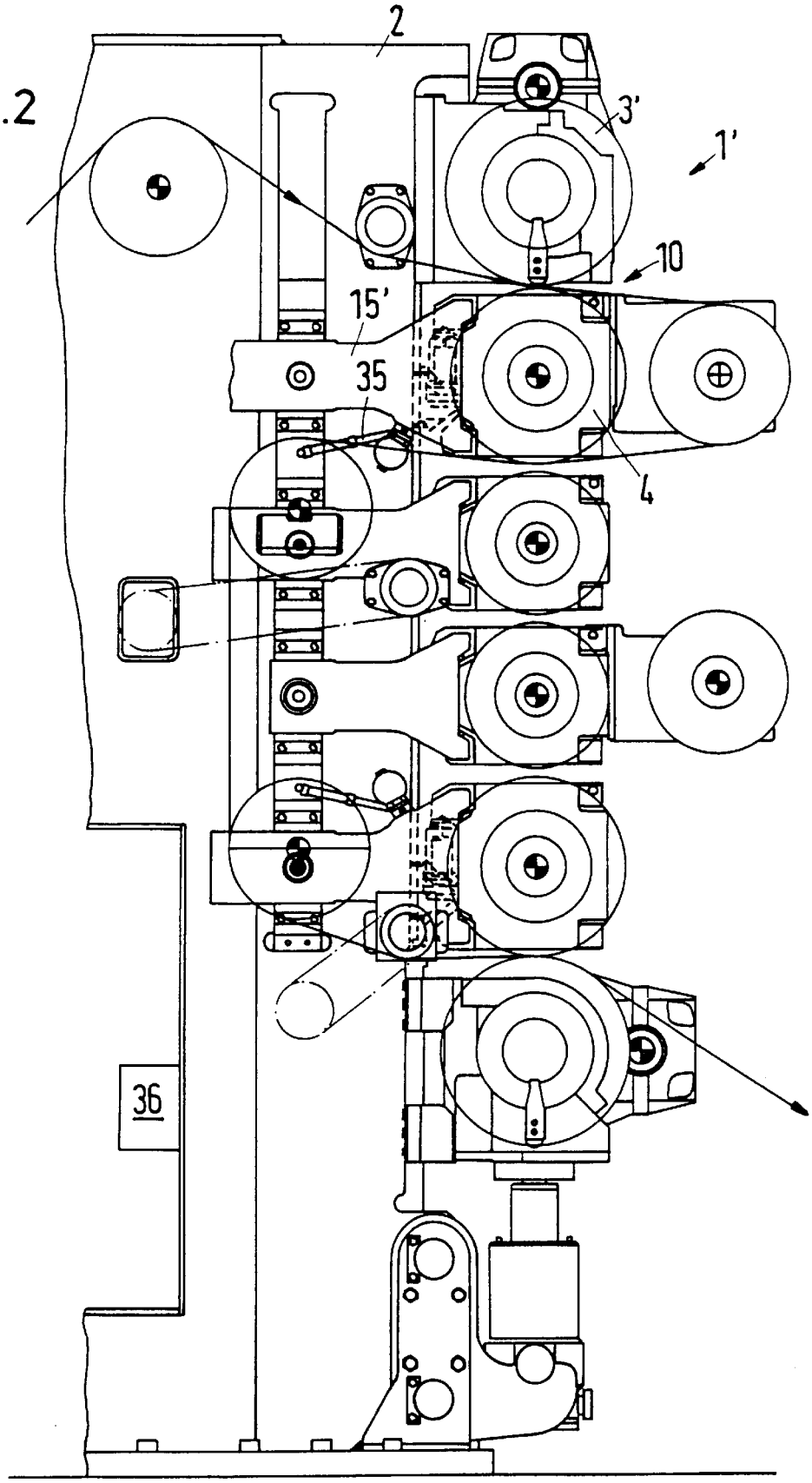
FIG. 2 illustrates a second embodiment of a calender in accordance with the present invention.

FIG. 2 illustrates an alternative embodiment of the present invention. In particular, a calender 1' is depicted in which the manner of closing top nip 10 is different than shown in FIG. 1.

In this alternative embodiment, roll 4 is mounted on a one-armed lever 15' that is fixedly positioned at a certain angular position to rolling stand 2 via a stopping device 35. Accordingly, roll 4 may be fixed in relation to rolling stand 2.

Top roll 3' may be formed as a press jacket roll so that the press jacket of top roll 3' may be lowered onto roll 4 to close nip 10. The remainder of the elements of calender 1' operate like those depicted in FIG. 1.

The control of both alternative arrangements is brought about through a schematically illustrated control device 36. For example, in the arrangement of FIG. 1, control device 36 may be coupled to lifting cylinder 20, pressure force transducer 27, and locking device 28 to control the method of operation of the calender 1. In the alternative arrangement of calender 1' in FIG. 2, control device 36 may be coupled to lifting cylinder 20, locking device 28, stopping device 35, and the adjusting device for pressing devices associated with press jacket roll 3'.

It is noted that the foregoing examples have been provided merely for the purpose of explanation and are in no way to be construed as limiting of the present invention. While the present invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A calender comprising:

a plurality of rolls having axes arranged to be substantially located in a press plane;

a plurality of nips being formed between adjacent rolls;

a control device to selectively open and close the plurality of nips;

wherein the control device selectively controls the nips to define at least a first nip position, at least a second nip position, and at least a third nip position, the first nip position comprising two open nips positioned between two closed nips, the second nip position comprising all open nips, and the third nip position comprising all closed nips.

2. The calender in accordance with claim 1, the closed nips being formed by both outer roll pairs.

3. The calender in accordance with claim 2, both end rolls comprising deflection adjustment rolls.

4. The calender in accordance with claim 1, at least one of the plurality of rolls forming the two closed nips comprising a driven roll.

5. A calender comprising:

a plurality of rolls having axes arranged to be substantially located in a press plane;

a plurality of nips being formed between adjacent rolls;

a control device to selectively open and close the plurality of nips;

the rolls being arranged so that at least two opened nips are positioned between two closed nips;

all of the plurality of rolls comprising driven rolls; and the driven rolls that form only the open nips being controlled individually.

6. The calender in accordance with claim 1, wherein one of the plurality of rolls forming a closed nip is positionally fixed in a rolling stand.

7. The calender in accordance with claim 1, wherein each of the closed nips comprises an upper roll which is adapted to be positionally fixed and a lower roll which is moveable by one of a pressure transducer and a lift drive.

8. The calender in accordance with claim 1, one of the rolls forming one of the two closed nips being stopped by at least one stopping device; and one of the rolls forming the other of the two closed nips comprising a pressure transducer.

9. The calender in accordance with claim 8, further comprising a two-armed lever having two ends; and the pressure transducer positioned to operate on one end of the two-armed lever and the roll forming the other of the two closed nips being positioned on the other end of the two-armed lever.

10. The calender in accordance with claim 1, at least one of the plurality of rolls being positionally fixed and comprising a press jacket roll.

11. The calender in accordance with claim 1, the two closed nips comprising soft nips.

12. The calender in accordance with claim 1, one of the opened nips comprising an alternate opening.

13. A calender comprising:

a plurality of rolls having axes arranged to be substantially located in a press plane;

a plurality of nips being formed between adjacent rolls;

a control device to selectively open and close the plurality of nips;

the rolls being arranged so that at least two opened nips are positioned between two closed nips;

one of the opened nips comprising an alternate opening; and the alternate opening being formed between two soft rolls.

14. The calender in accordance with claim 1, the plurality of tolls comprising six rolls.

15. The calender in accordance with claim 1, further comprising guide rolls arranged to bypass the open nips.

16. A calender comprising:

a plurality of rolls substantially parallelly arranged in a press plane;

the plurality of rolls comprising a top roll and a bottom roll with at least three rolls disposed therebetween;

a control device that moves the plurality of rolls substantially along the press plane to selectively open and close press nips;

wherein the control device selectively controls the nips to define at least a first nip position, at least a second nip position, and at least a third nip position, the first nip position comprising two open nips positioned between two closed nips, the second nip position comprising all open nips, and the third nip position comprising all closed nips.

17. The calender in accordance with claim 16, the plurality of rolls further comprising:

a top counter roll associated with the top roll to form a first press nip; and a bottom counter roll associated with the bottom toll to form a second press nip.

18. The calender in accordance with claim 17, the top counter roll and the bottom counter roll comprising a roll having a hard outer surface; and the plurality of rolls further comprising a first soft roll and a second soft roll positioned the top and bottom counter rolls.

19. A calender comprising:

a plurality of rolls substantially parallelly arranged in a press plane;

the plurality of rolls comprising a top roll and a bottom roll;

a control device that moves the plurality of rolls substantially along the press plane to selectively open and close press nips; and the control device being adapted to move the plurality of rolls to form at least two open nips between closed nips;

the plurality of rolls further comprising:

a top counter roll associated with the top roll to form a first press nip; and a bottom counter roll associated with the bottom roll to form a second press nip;

the top counter roll and the bottom counter roll comprising a roll having a hard outer surface; and the plurality of rolls further comprising a first soft roll and a second soft roll positioned between the top and bottom counter rolls; and the first and second soft rolls forming an alternate nip.

20. The calender in accordance with claim 19, each of the plurality of rolls being driven rolls; and the first and second soft rolls being driven independently of the remainder of the plurality of rolls.

21. The calender in accordance with 17, the control device being adapted to relatively move the top roll and top counter roll into contact to close the first press nip.

22. The calender in accordance with claim 21, further comprising:

a two-armed lever coupled to the top counter roll;

a pressure transducer coupled to the two-armed lever to selectively open and close the first press nip; and the top roll being substantially positionally fixed in the press plane.

23. The calender in accordance with claim 21, further comprising:

a lever coupled to the top counter roll to positionally fix the top counter roll in the press plane; and the top roll comprising a press jacket roll being adapted to press the press jacket against the top counter roll.

24. The calender in accordance with claim 17, the control device being adapted to relatively move the bottom roll and the bottom counter roll into contact to close the second press nip.

25. The calender in accordance with claim 24, further comprising:

a slider device coupled to the bottom roll;

a driver device being adapted to move the slider device substantially parallel to the press plane to selectively open and close the second press nip;

a lever coupled to the bottom counter roll; and a stop element coupled to the lever to positionally fix the bottom counter roll in the press plane.

26. The calender in accordance with claim 16, further comprising:

a plurality of guide rolls arranged to guide a material web through the closed nips and to bypass the open nips.

27. A method of treating a material web in a calender having a plurality of rolls substantially parallelly arranged in a press plane that includes a top roll and a bottom roll with at least three rolls disposed therebetween, a control device that moves the plurality of rolls substantially along the press plane to selectively open and close press nips, wherein the control device selectively controls the nips to define at least a first nip position, at least a second nip position, and at least a third nip position, the first nip position comprising two open nips positioned between two closed nips, the second nip position comprising all open nips, and the third nip position comprising all closed nips, the method comprising:

forming a closed nip with the top roll;

forming a closed nip with the bottom roll;

forming at least two open nips between the closed nips; and guiding the material web through the closed nips.

28. The method in accordance with claim 27, the forming of the closed nip with the top roll comprising:

fixing a position of the top roll to substantially prevent radial movement; and applying pressure to one arm of a two-armed lever to press a top counter roll against the top roll.

29. The method in accordance with claim 27, the forming of the closed nip with the top roll comprising:

fixing a position of the top roll to substantially prevent radial movement, wherein the top roll is comprised of a press jacket roll;

fixing a position of a top counter roll adjacent the top roll; and pressing the press jacket of the press jacket roll against the top counter roll.

30. The method in accordance with claim 27, the forming of the closed nip with the bottom roll comprising:

fixing a position of a bottom counter roll to substantially prevent radial movement; and radially moving the bottom roll to press the bottom roll against the bottom counter roll.

31. The method in accordance with claim 27, further comprising:

positioning two soft rolls between, but not adjacent to, the top roll and the bottom roll.

32. A method of treating a material web in a calender having a plurality of rolls substantially parallelly arranged in a press plane that includes a top roll and a bottom roll, a control device that moves the plurality of rolls substantially along the press plane, the method comprising:

forming a closed nip with the top roll;

forming a closed nip with the bottom roll;

forming at least two open nips between the closed nips;

guiding the material web through the closed nips;

positioning two soft rolls between, but not adjacent to, the top roll and the bottom roll; and driving the two soft rolls independently of the top roll and the bottom roll.

33. A calender comprising:

a plurality of rolls substantially parallelly arranged in a press plane;

the plurality of rolls comprising a top roll and a bottom roll with at least three rolls disposed therebetween;

the plurality of rolls further comprising a top counter roll associated with the top roll to form a first press nip and a bottom counter roll associated with the bottom roll to form a second press nip;

the top roll comprising a press jacket roll being adapted to press the press jacket against the top counter roll;

a control device that moves the plurality of rolls substantially along the press plane to selectively open and close press nips;

the control device being adapted to relatively move the top roll and top counter roll into contact to close the first press nip;

the control device being adapted to move the plurality of rolls to form at least two open nips between closed nips; and a lever coupled to the top counter roll to positionally fix the top counter roll in the press plane, wherein the control device is adapted to selectively close each of the closed nips while each of the open nips remain open.

34. A calender comprising:

a plurality of rolls substantially parallelly arranged in a press plane;

the plurality of rolls comprising a top roll and a bottom roll with at least three rolls disposed therebetween;

the plurality of rolls further comprising a top counter roll associated with the top roll to form a first press nip and a bottom counter roll associated with the bottom roll to form a second press nip;

a control device that moves the plurality of rolls substantially along the press plane to selectively open and close press nips;

the control device being adapted to move the plurality of rolls to form at least two open nips between closed nips;

the control device being adapted to relatively move the bottom roll and the bottom counter roll into contact to close the second press nip;

a slider device coupled to the bottom roll;

a driver device being adapted to move the slider device substantially parallel to the press plane to selectively open and close the second press nip;

a lever coupled to the bottom counter roll;

a stop element coupled to the lever to positionally fix the bottom counter roll in the press plane, wherein the control device is adapted to selectively close each of the closed nips while each of the open nips remain open.

35. A method of treating a material web in a calender having a plurality of rolls substantially parallelly arranged in a press plane that includes a top roll and a bottom roll with at least three rolls disposed therebetween, a control device that moves the plurality of rolls substantially along the press plane to selectively open and close press nips, the method comprising:

forming a closed nip with the top roll;

the forming of the closed nip with the top roll comprising fixing a position of the top roll to substantially prevent radial movement wherein the top roll is comprised of a press jacket roll, fixing a position of a top counter roll adjacent the top roll, and pressing the press jacket of the press jacket roll against the top counter roll;

forming a closed nip with the bottom roll;

forming at least two open nips between the closed nips; and guiding the material web through the closed nips, wherein the control device is adapted to selectively close each of the closed nips while each of the open nips remain open.

* * * * *